United States Patent [19]

Doschko et al.

[11] 3,939,632

[45] Feb. 24, 1976

[54] PROCESS FOR THE PRODUCTION OF EFFECT YARNS

[75] Inventors: Werner Doschko, Nussloch; Hans Pscheidl, Heidelberg, both of Germany

[73] Assignee: Imperial Chemical Industries Limited, London, England

[22] Filed: May 14, 1973

[21] Appl. No.: 257,404

[52] U.S. Cl. ..... 57/34 HS; 57/77.4; 57/157 TS

[51] Int. Cl.[2]... D02G 1/02; D01H 7/92; D02G 1/04

[58] Field of Search ..... 57/34 R, 34 HS, 34 AT, 57/140 J, 156, 157 TS, 157 MS, 157 R, 77.3–77.45, 91, 92, 93, 94

[56] References Cited

UNITED STATES PATENTS

| | | | |
|---|---|---|---|
| 2,961,010 | 11/1960 | Berry | 57/34 AT |
| 3,009,312 | 11/1961 | Seem et al. | 57/34 HS X |
| 3,095,630 | 7/1963 | Pittman | 57/34 HS |
| 3,166,881 | 1/1965 | Servage | 57/157 TS X |
| 3,269,105 | 8/1966 | Eldridge et al. | 57/140 J |
| 3,415,048 | 12/1968 | Welbers | 57/34 AT |
| 3,468,120 | 9/1969 | Hildebrand | 57/77.3 X |
| 3,685,273 | 8/1972 | Neveux | 57/77.4 |
| 3,724,196 | 4/1973 | Holland et al. | 57/77.4 |
| 3,802,175 | 4/1974 | Doschko | 57/157 TS X |

*Primary Examiner*—Donald E. Watkins
*Attorney, Agent, or Firm*—Herbert M. Adrian, Jr.

[57] ABSTRACT

Producing effect yarns using the false twist principle by varying the twist density in the heater zone to alter the degree of bulk and thus the texture along the length of the finished yarn.

10 Claims, 3 Drawing Figures

PROCESS FOR THE PRODUCTION OF EFFECT YARNS

Figure 1:
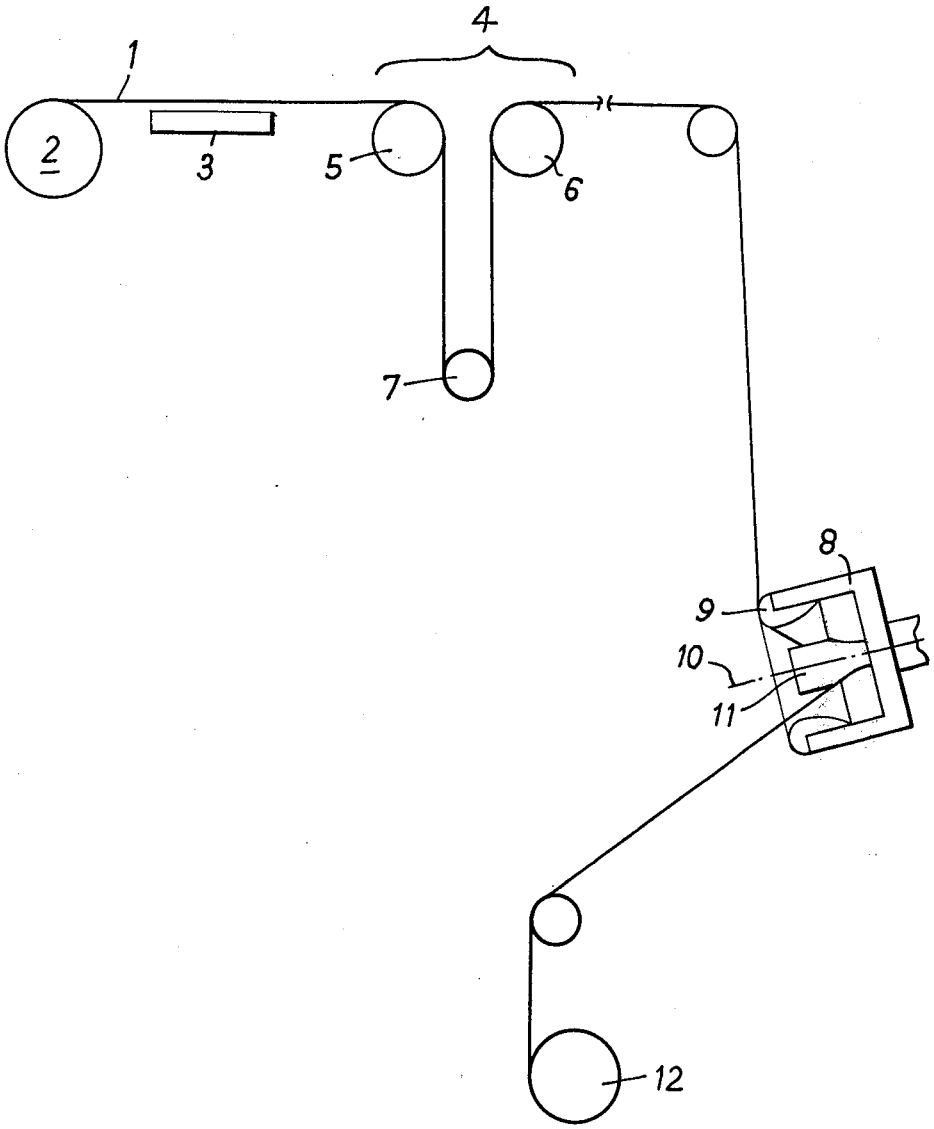

The present invention relates to a process for the production of an effect yar. An effect yarn is a textured yarn in which the degree of texturising varies along the length of the yarn.

Textured yarn can be produced in several ways, one of which consists of imparting a false twist to the yarn. A false twist is achieved by first passing a moving yarn through a region where it is heated to above the second order transition temperature of the materials from which the yarn is made, subsequently cooling the yarn and then twisting the cooled yarn. The twist imparted to the yarn runs back along the yarn in the opposite direction to that in which the yarn is travelling into the heating zone where the heat sets the yarn in its twisted form. After the yarn has passed through the twisting device it untwists so that the untwisting of the yarn which has been set in its twisted state results in a texturised yarn.

The bulk in the finally texturised yarn is mainly dependent on the twist density of the yarn in the heating zone. By twist density we mean the number of twists per unit length in the yarn. Twist density is controlled by the nature and physical properties of the yarn supplied, i.e. its chemical type, title, number of filaments in the cross section and by the physical properties of the filaments, and also by the imposed processing conditions, namely yarn speed, twisting speed, time and temperature of heating and cooling and by frictional forces in the twisting device.

The present invention relates to producing an effect yarn wherein the texturising in imparted by the false twist principle.

According to the present invention we provide a process for the production of an effect yarn as hereinbefore described wherein a continuously moving yarn passes through a zone where it is heated to a temperature above its second order transition temperature, then through a cooling zone and is then twisted whereby the twist inserted runs back into the heating zone characterised in that the degree of twist set by the heating zone is varied to produce a yarn having a varying degree of bulk along its length.

The degree of twist set by the heating zone may be varied either by varying the amount of heating or the amount of twist in the zone. For example, if the twist is imparted to the yarn by means of a friction twist bush the arc of the contact between the bush and the yarn may be varied to vary the degree of twist. Alternatively the yarn may be moved towards and away from the heater to vary the amount by which the yarn is heated and thus the extent to which the twist is set in the yarn. Our preferred method is however to provide a twist damming element which is adjustable to vary the extent to which the twist is dammed. The twist damming element may be positioned either side of the heating zone, for example it may be positioned between the heating zone and the twisting zone providing it acts on the yarn when it is at a temperature below its second order transition temperature. This is our preferred method of operation although the damming element may act on the yarn before it reaches the heater so that it may be varied to vary the extent to which the twist can bleed back beyond the heater.

It is known that when a yarn is twisted, the twist will run along the length of the yarn but the twist may be prevented from running if a constriction such as a dramatic change in direction is provided in the yarn path. This phenomenon is known as twist damming. Thus in our preferred method of operation we have found that the degree of twist damming in a moving yarn can be controlled and if this discovery is applied to the texturising of yarn by the false twist principle, the twist in the heating zone may be varied and an effect yarn thereby produced.

The yarn used in the process of the present invention may by any thermoplastic synthetic yarn which when heated to above its second order transition temperature while in its twisted state becomes set in its twisted configuration. The techniques of the present invention may be applied to drawn yarn, to processes in which the yarn is drawn and twisted simultaneously and to processes in which the yarn is twisted immediately after drawing. The present invention is particularly useful in the production of effect yarns from nylon 6, nylon 6:6, polyacrylonitrile and polyesters.

The yarn may be fed directly from the feed roll through the heater zone which in certain embodiments of the invention is also the zone where the yarn is drawn. The heater zone may be the same as the heater zone used in conventional false twisting processes and a standard type of plate heater is particularly convenient. Similarly the cooling zone which is necessary to ensure that the yarn is cold when it is twisted may be a cooling zone of the type generally used in conventional false twist processes. It may be necessary to provide cooling plates which direct cold air onto the yarn but generally we find that the distance the yarn must travel between the heater and the twist device is sufficient to cool the yarn.

The yarn is generally cold when twisted and may be twisted by any suitable form of twisting device, in particular the twist bushes such as those described in British Patents 797,051 and 801,335; British Patent 1,197,703 or, as is preferred, the device described in our own copending application Ser. No. 232,375 filed Mar. 7, 1972 and now U.S. Pat. No. 3,802,175 are especially useful.

As previously mentioned our preferred method employs a twist damming element positioned anywhere between the heater zone and the twisting device at a position where the temperature of the yarn is below its second order transition temperature, preferably at least 20° C. below this temperature when it passes through the device. In this embodiment the twist damming element should apply a constraint to the yarn whilst allowing the yarn to travel. In addition the element should be readily adjustable to vary the constraint on the yarn without interrupting the travel of the yarn. The twist damming element may conveniently be a yarn guide which may be moved to alter the constraints placed upon the yarn, for example it may consist of two rollers around which the yarn passes and a yarn guide between the rollers, the position of the yarn guide being adjustable so as to vary the amount by which it is necessary for the direction of the yarn path to change as it passes around the rollers. Alternatively, the twist damming element may be an arm which bears against the yarn and is pivoted to allow the force of the arm against the yarn to be increased or decreased as is required. Thus the force may be varied without stopping the yarn and thus the twist density in the heating zone may be varied while the yarn is travelling, thus giving rise to a variation in the textured effect in the finished yarn.

The means that is used to control the degree of twist in the heating zone may be operated in any suitable manner depending on the effect required in the yarn. For instance, the position of the twist damming element, the extent to which the yarn bears against a friction twist bush, or the distance between the twisted yarn and the heater may be controlled by a signal which may be emitted according to a predetermined time cycle to produce a yarn having any required variation in texturising. For example, when a twist damming device consisting of two rollers and a yarn guide as described above is used, the position of the yarn guide relative to the two rollers may be regularly varied to give a regular variation in the constraint placed upon the yarn by the twist damming device.

A preferred embodiment of the present invention is illustrated but in no way limited by reference to the accompanying drawings in which FIG. 1 is a diagrammatic illustration of one embodiment of the present invention.

Figure 2:
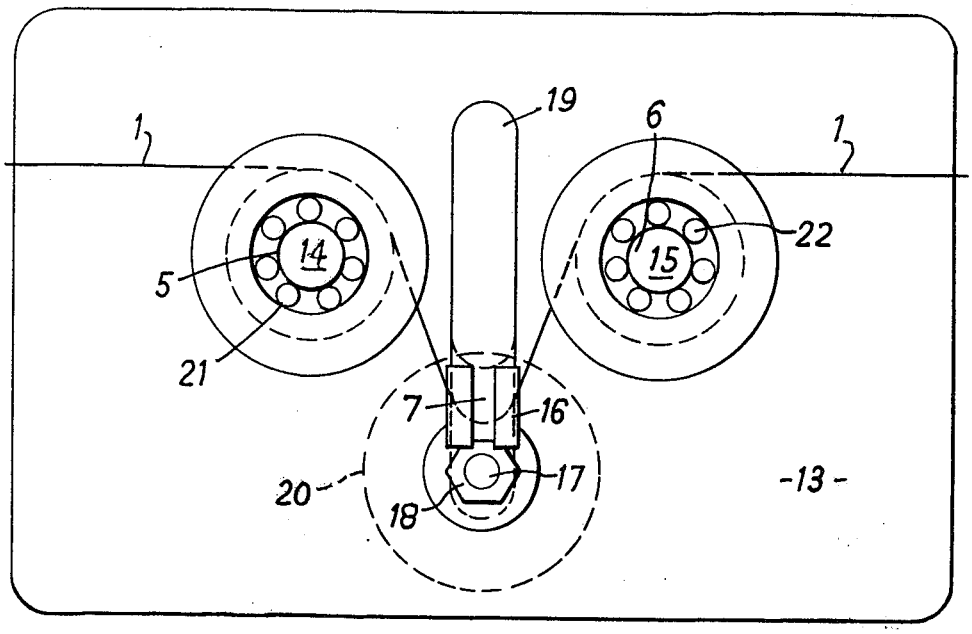
Figure 3:
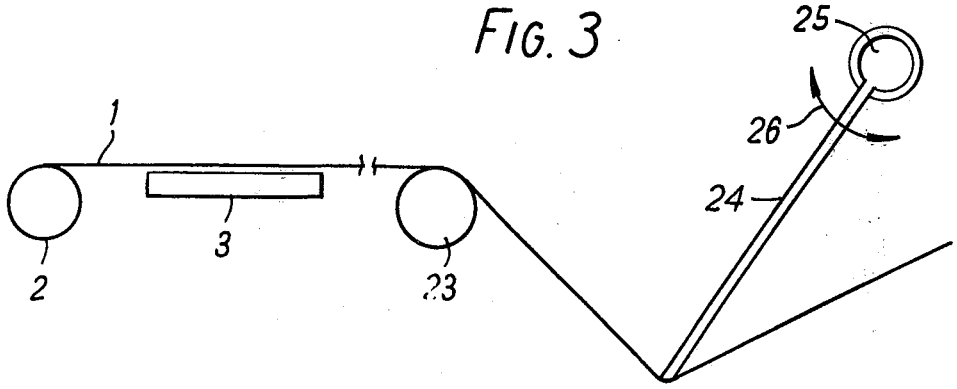

FIG. 2 is an enlarged and more detailed view of the twist damming element shown in FIG. 1, and FIG. 3 is a diagrammatic illustration of an alternative form of twist damming element.

FIG. 1 is a schematic illustration of a process for producing effect yarn. In this process the yarn 1 is withdrawn from the feed roll 2, carried over the heater 3 where it is heated to the twist setting temperature; the yarn then cools as it runs from the heater into a twist damming element 4. The twist damming element consists of idler rollers 5 and 6 and a yarn guide 7, rollers 5 and 6 are in fixed positions whereas guide 7 may be moved up and down in the manner shown by the arrows. After passage through the twist damming element, the yarn passes to the twist unit 8 which consists of a circular friction bush 9 which is rotated about the axis 10 so that the frictional contact between the rotating bush and the yarn imparts a twist to the yarn. The yarn is held against the friction bush by means of the yarn guide element 11 which is itself free to rotate as the yarn passes around it. Finally the yarn is wound up on the take off roll 12.

FIG. 2 shows the twist damming element 4 in more detail and shows the rollers 5 and 6 mounted on a support plate 13 by means of shafts 14 and 15 respectively. The rollers 5 and 6 are free to rotate on the ball races 21 and 22. The yarn guide element 7 acts as a damming element as there is a dramatic change in yarn direction as it passes around the guide, thus damming the run of the twist. Guide 16 is mounted on the shaft 17 which passes through the channel 19 formed in the plate 14. The shaft 17 is held firm by virtue of the nut 18 and the washer 20 positioned behind the plate. The shaft is however free to move up and down within the channel 19 thus altering the angle through which the yarn is forced to turn about the guide 16 and thus varying the twist damming effect according to the position of the shaft.

Thus in operation of the process twist is imparted to the yarn by the twist bush and passes back along the yarn until it reaches the twist damming unit. The position of the guide 7 controls the amount of constraint on the yarn and thus the amount of twist which passes back into the heating zone to become set in the yarn. Any twist that is prevented from passing the guide 7 is lost when the yarn passes the twisting device.

Accordingly by moving guide 7 up and down at a predetermined speed, yarn will be produced which is textured to a varying extent along the length of the yarn. The frequency of the variations along the yarn will depend upon the speed at which the guide 7 is moved up and down and the speed at which the yarn is travelling.

FIG. 3 is a diagrammatic illustration of an alternative form of twist damming element. The element 4 of FIG. 1 is replaced by a single roll 23 and a lever arm 24 which is pivoted about the axis 25. Thus by oscillating the arm 24 in the manner shown by the arrow 26, the angle through which the yarn path is forced to turn by the arm and thus the extent the twist is dammed by the arm may be varied. The twist device and take up units are not shown in FIG. 2 but they may be identical with the system shown in FIG. 1 and the principle by which the two systems operate is the same.

The present invention is further illustrated by reference to the following examples.

Example 1

Drawn nylon 6:6 yarn was fed first over a feed roll, then in close contact with a 1.50 m. long plate heater. The yarn was subsequently passed through a device of the type illustrated in FIG. 1 and 2, the yarn guide 8 being in a position such that no deflection of the yarn occurred. Following this, the yarn was passed over guides through a 1.0 m. long cooling zone to a false twist device, and finally over a second roll to a wind up. The twist applied by the false twisting device was imparted to the yarn and was present in that part of the yarn which was heated to the thermoplastic region. Detwisting occurred after the yarn had passed through the false twist device.

Example 2

Example 1 was repeated with the yarn guide of the device illustrated in FIGS. 1 and 2 in a position such that a large deflection of the yarn took place.

Example 3

Example 1 was repeated with a different nylon yarn.

Example 4

Example 2 was repeated with the same nylon yarn as used in Example 3.

The results of Examples 1 to 4 are summarised in the following table:

| Example | Yarn Type (Drawn Decitex) | | Twist in yarn in the heating zone (turns/meter) | Twist inserted in yarn by false twist device (turns/meter) |
|---|---|---|---|---|
| 1 | Nylon 6:6 | 78 dtex | 2,503 | 4,273 |
| 2 | Nylon 6:6 | 78 dtex | 620 | 3,060 |
| 3 | Nylon 6:6 | 110 dtex | 1,663 | 2,793 |

-continued

| Example | Yarn Type (Drawn Decitex) | | Twist in yarn in the heating zone (turns/meter) | Twist inserted in yarn by false twist device (turns/meter) |
|---|---|---|---|---|
| 4 | Nylon 6:6 | 110 dtex | 10 | 2,710 |

Thus it can readily be seen that by varying the position of the yarn guide 8 the amount of twist which is fed back to the heating zone and the level of twist inserted by the false twist unit may be varied.

Example 5

Using the same conditions as in Example 1 the yarn guide was caused to move by an external signal at a frequency of about 1 complete cycle per sec., thus having the effect of alternating conditions of Examples 1 and 2.

Example 6

Example 5 was repeated using the conditions of Examples 3 and 4.

We claim:

1. In a process for the production of a continuously textured effect yarn wherein a yarn is continuously false twist textured, said process comprising forwarding a yarn to be textured from feed means sequentially through a heated zone wherein it is heated to a temperature above its second order transition temperature, a cooling zone, and a false twisting zone to a takeup zone, wherein the twist imposed in the false twisting zone runs back into the heating zone, the improvement which comprises periodically reducing the twist set in the yarn to corresponding vary the degree of bulk along the length of said yarn at constant yarn and twisting speed.

2. The process of claim 1, wherein the twist set is varied by varying the amount by which the yarn is heated in the heated zone.

3. The process of claim 1, wherein the twist set is varied by varying the amount of twist which is allowed to run back into the heating zone.

4. The process of claim 3 wherein the twist density of the yarn in the heating zone is reduced relative to the twist inserted by a factor of at least about 1:5.

5. The process of claim 4, wherein said twist density is continuously varied between maximum and minimum values over a period of about 1 cycle per second.

6. A process according to claim 1 in which the yarn is drawn while it is being twisted.

7. A process according to claim 1 in which the yarn is twisted immediately after it has been drawn.

8. A process according to claim 1 in which the yarn is a polyamide yarn.

9. A process according to claim 1 in which the yarn is a polyester yarn.

10. In an apparatus for the production of continuously textured effect yarns comprising yarn feed means, means for heating the yarn to a temperature above its second order transition temperature, means for false twisting comprising a friction twist bush which bears against the yarn, and takeup means, the improvement constituting means for periodically reducing the twist set in the yarn, said means comprising a yarn guide for altering the arc of contact between the twist bush and the yarn.

* * * * *